US009290238B2

(12) United States Patent
Bjoland et al.

(10) Patent No.: US 9,290,238 B2
(45) Date of Patent: Mar. 22, 2016

(54) METHOD AND A DEVICE FOR MAINTAINING OR REPLACING A TETHER LINE

(71) Applicants: Lars Bjoland, Agotnes (NO); Eldar Lien, Bergen (NO)

(72) Inventors: Lars Bjoland, Agotnes (NO); Eldar Lien, Bergen (NO)

(73) Assignee: SELANTIC AS, Blomsterdalen (NO)

( * ) Notice: Subject to any disclaimer, the term of this patent is extended or adjusted under 35 U.S.C. 154(b) by 0 days.

(21) Appl. No.: 14/397,554

(22) PCT Filed: Apr. 30, 2013

(86) PCT No.: PCT/NO2013/000019

§ 371 (c)(1),
(2) Date: Oct. 28, 2014

(87) PCT Pub. No.: WO2013/165253

PCT Pub. Date: Nov. 7, 2013

(65) Prior Publication Data

US 2015/0117957 A1 Apr. 30, 2015

(30) Foreign Application Priority Data

Apr. 30, 2012 (NO) ..... 20120499

(51) Int. Cl.

| | |
|---|---|
| ***B63B 22/04*** | (2006.01) |
| ***B63B 22/18*** | (2006.01) |
| ***B63B 21/04*** | (2006.01) |
| ***B63B 21/22*** | (2006.01) |

(52) U.S. Cl.

CPC ..... *B63B 21/04* (2013.01); *B63B 21/22* (2013.01); *B63B 22/04* (2013.01); *B63B 22/18* (2013.01)

(58) Field of Classification Search

CPC ..... B63B 22/04; B63B 22/18
USPC ..... 405/171, 224; 441/1, 6, 21, 23
See application file for complete search history.

(56) References Cited

U.S. PATENT DOCUMENTS

| | | | | |
|---|---|---|---|---|
| 3,728,748 | A * | 4/1973 | Roehler, II | 441/23 |
| 3,742,535 | A | 7/1973 | Horrer | |
| 5,370,366 | A | 12/1994 | Ottemann | |
| 5,716,249 | A * | 2/1998 | Dyhrberg | 441/3 |
| 6,595,725 | B1 * | 7/2003 | Shotbolt | 405/224.2 |
| 7,244,155 | B1 | 7/2007 | Nye | |
| 2011/0020067 | A1 * | 1/2011 | Espinasse et al. | 405/166 |

FOREIGN PATENT DOCUMENTS

| | | |
|---|---|---|
| DE | 25 34 045 | 2/1976 |
| FR | 2 8389 110 | 10/2003 |
| GB | 625061 | 6/1949 |
| JP | 57-167887 | 10/1982 |
| JP | 2009269683 | 11/2009 |
| NL | 1017854 C1 | 10/2002 |
| SU | 1744056 A1 | 6/1992 |
| WO | WO 85/00581 | 2/1985 |
| WO | WO 2009/124334 | 10/2009 |

* cited by examiner

*Primary Examiner* — Frederick L Lagman
(74) *Attorney, Agent, or Firm* — Francis C. Hand; Carella, Byrne, et al

(57) ABSTRACT

The invention relates to a method for maintaining or replacing a tether line (22) anchoring a buoyancy unit to an underwater or seabed anchoring installation, characterized in that a pull down line (12,12*a*, 12*b*″) is connected to the buoyancy unit and the line is guided through a block (21) fixed to the lower anchoring installation, and then the buoyancy unit is pulled down to slacken the tether line (22), and the sufficient maintenance or replacement is performed. A device is also disclosed.

13 Claims, 4 Drawing Sheets

METHOD AND A DEVICE FOR MAINTAINING OR REPLACING A TETHER LINE

BACKGROUND OF INVENTION

The present invention relates to a method and a device for maintaining or replacing a tether line anchoring a buoyancy unit to an underwater or seabed anchoring installation.

In this respect, reference is made to Japanese patent publication JP-57167887 and U.S. Pat. No. 6,457,908.

The upper termination part of a tether line is normally connected to the buoyancy unit by means of an upper interface component, while the lower tether termination part is connected to a lower interface component connected to a sea bed installation such as a sea bed anchor. The two interphase components, or also named coupling units, include well known hinge couplings performing a universal joint function when the buoyancy unit moves in the sea volume.

The area of application for the present invention is illustrated in the enclosed FIG. 1. A buoyancy unit 11, or pontoon unit, also named a mid water arch (MWA) is kept in position in the body of water 100 at a distance below the sea level/surface 24 by means of two tether lines 22*a*,22*b*. The upper part of each tether line is connected to the bottom of the pontoon 11, while the lower tether part is connected to an anchor structure 19A, 19B fixed to the sea bed surface 23. To save weight the lines in question is preferably made of synthetic fibers instead of steel wire rope.

In the example shown in FIG. 1, the buoyancy unit 11 is used to support or suspend a number of lines 120 that for example runs partly floating on their own, in smooth patterns from a sea bed installation in a hydrocarbon production plant (not shown) upwards through the body of water to a processing plant platform (not shown).

BRIEF SUMMARY OF THE INVENTION

The object of the invention is to improve the possibility to maintain and replace tether arrangements connecting buoyancy units to a sea bed installation.

An object of the invention is to improve said maintenance and replacing possibility without, or to a very small extent, adding substantially weight load to the buoyancy unit.

The method is characterized in that a pull down line is connected to the buoyancy unit and the line is guided through a block fixed to the lower anchoring installation, and then the buoyancy unit is pulled down to slacken the tether line, and the sufficient maintenance or replacement is performed.

The invention is now explained more in detail by reference to the following description and the enclosed drawing figures.

DETAILED DESCRIPTION OF THE INVENTION

Figure 1:
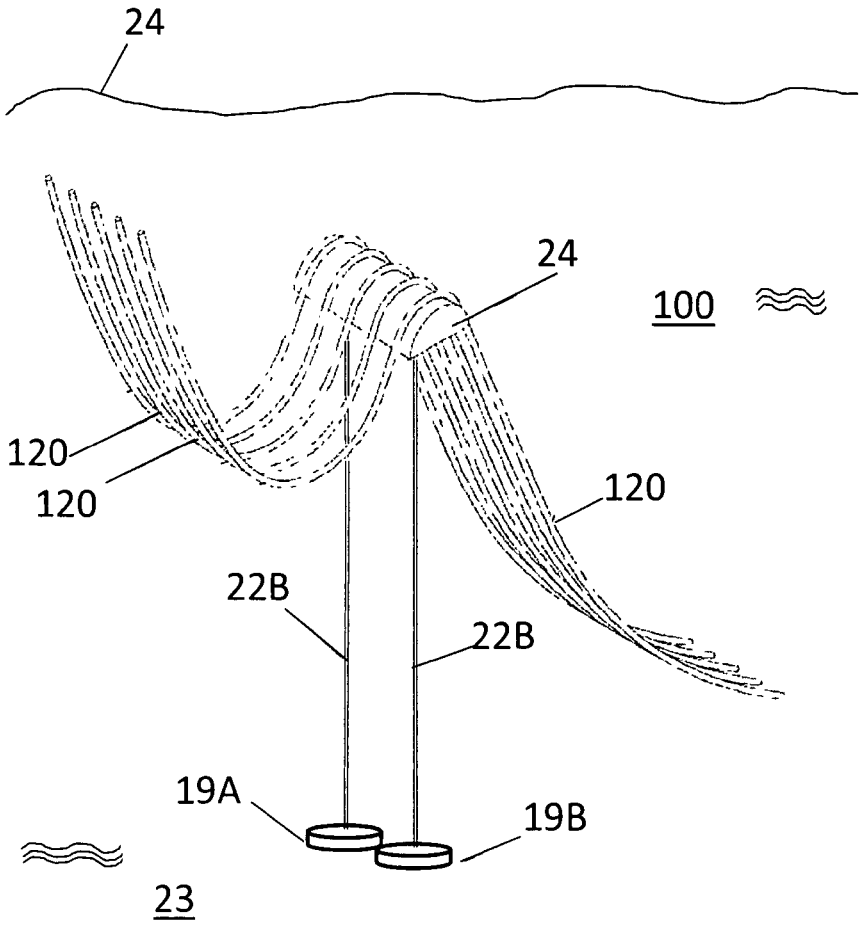
FIG. 1 shows the area of use for the present invention.
Figure 2:
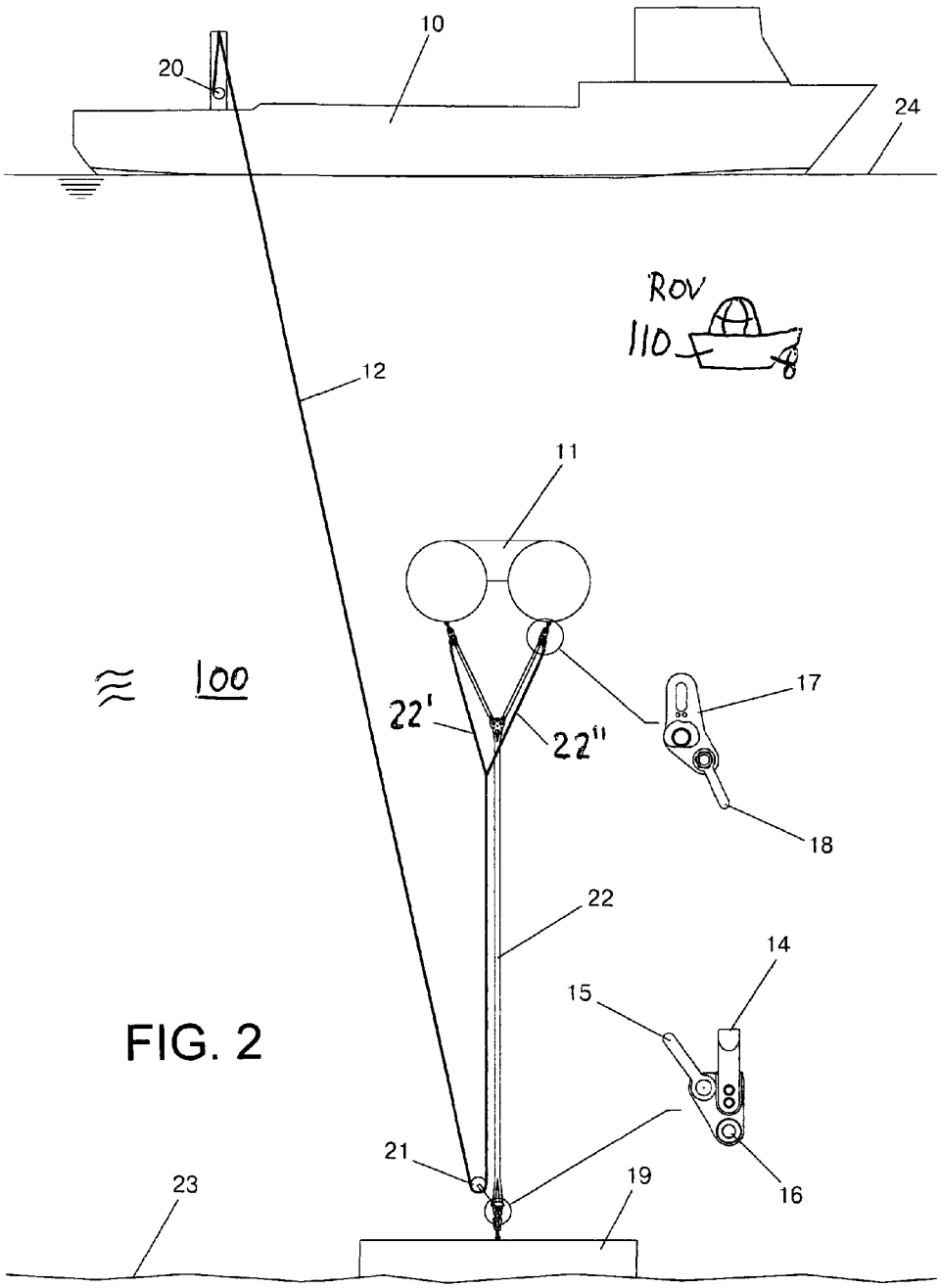
FIG. 2 shows the tether system including the present invention.

As shown in FIG. 2, the mid water arch (MWA) or pontoon 11 or similar buoyancy unit, is normally kept in a position between the seabed 23 and the surface 24 by a tether arrangement 22 connected to the buoyancy unit 11 by means of the upper components 17 and through the lower anchor coupling unit 14 to the anchor 19 or similar unit on the sea bed, both including trunnion units. This is the typical and well-known tether arrangement. The tether material could be steel wire rope, chain or synthetic fibre. In a replacement operation, synthetic fibre has an advantage because of the significantly lower weight. As shown the buoyancy unit is floating mid way in the sea water volume between the sea surface 24 and the sea bed 23 by means of said tether lines 22.

When replacement of tether 22 is required, a ROV I submerged from the installation vessel 10 will bring down the hooks of the pull-down bridle 22',22" (or pull-down line if single line) and connect these to the pre-arranged shackles 18 on the MWA 11 interface components 17*a,b*. Further, the ROV will bring down the block 21 (or a pulley structure) and connect this to the anchor interface component 14 through the shackle 15 which is fixed to the interface component 14. The anchor interface 14 is fixed to the sea bed. A line 12 is conducted from the winch or crane 20 down to the anchor interface, through the block or pulley 21 and upwardly to pre-arranged shackles 18 on the MWA interface components 17. As shown the line 12 is split in two branches 22',22" forming a Y-shape (on FIG. 2), each branch is connected to its respective shackle 18*a*,18*b* connected to each side of the MWA via the connecting elements 17*a*,17*b*.

The winch or crane 20 on the installation ship will now tighten and pull in the line 12 forcing or pulling the MWA 11 further down and deeper into the body of water 100 and by this taking over the tether load. The tether line arrangement 22 is now relieved and slack and may be replaced, or safely maintained, by the use of said ROV 100 (see FIG. 2). Both the upper and lower interface components, respectively 17*a*,17*b* and 14, are prepared for ROV operation of the tether connection/disconnection, which means both connecting the block or pulley structure 21 to the shackle 15 on the lower coupling unit including a padeye 16 for connection to the anchor structure 19 or other dedicated structure on the sea bed 23.

Figure 3:
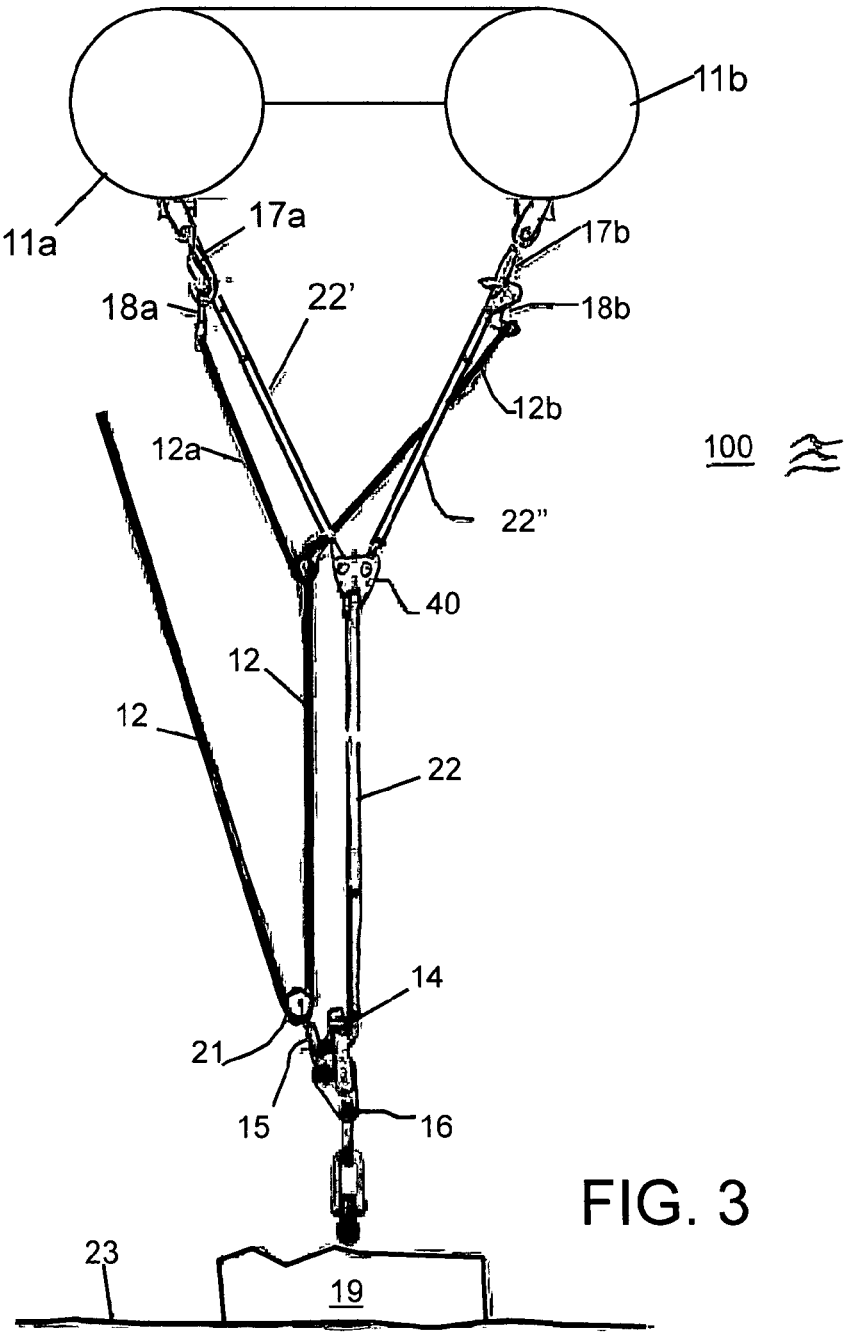
FIG. 3 shows a closer view of the present applied to a tether system.

The drawing FIG. 3 show the main structure more in detail.

Figure 4:
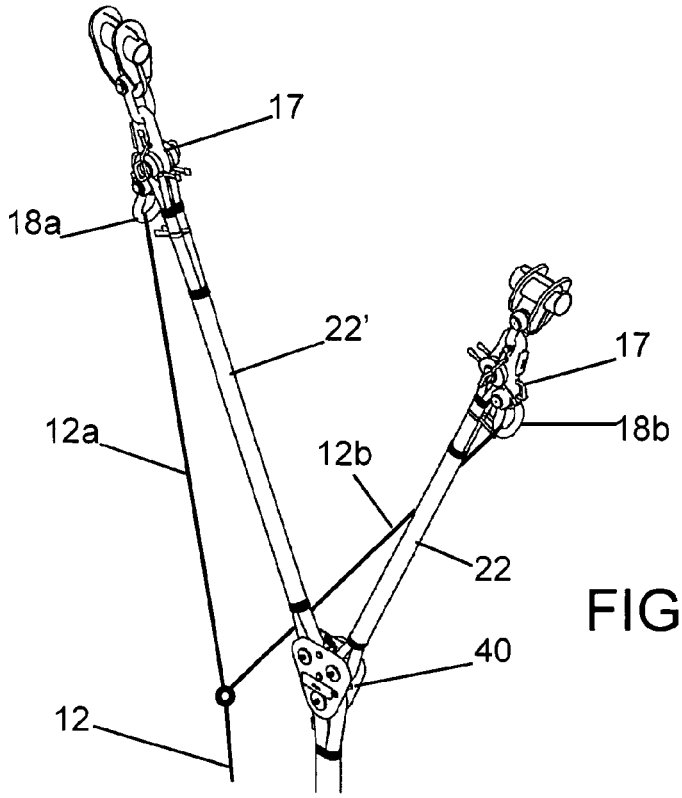
FIG. 4 shows an enlarged view of the upper coupling structure 17 connecting the tether 22,22',22" to the pontoon 11.

FIG. 4 shows the detailed structure of the upper Y-shaped structure of the tether system 22, and how the pull down line 12 is branched in two branch lines 12*a*,12*b*, a bridle line shape.

Figure 5A:
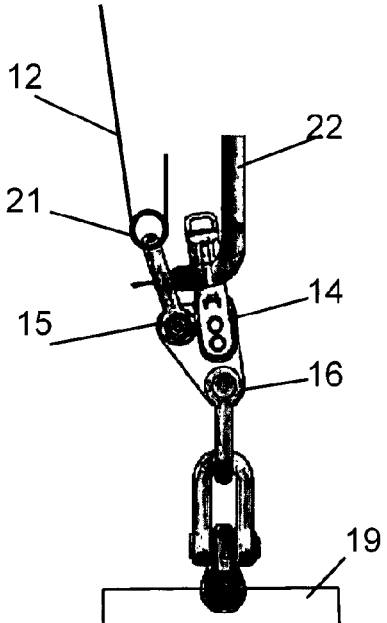
FIGS. 5*a* and 5*b* shows the lower coupling structure (an anchor interface component 14) connecting the lower end of the tether to the sea bed anchor structure 19.
Figure 5B:
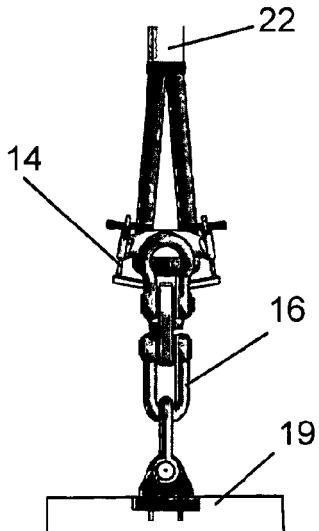

FIGS. 5*a* and 5*b* show in two sections, the lower connecting element 14 fastened to the anchor structure.

Normally, a MWA 11 has a limited number of padeyes and load attachment points. An efficient MWA will typically have a minimum of structure to achieve as much net buoyancy as possible. By adding an extra attachment point to the interface component, no additional structure is required for the MWA and only a minimum of additional mass and weight is added to the upper and lower interface components.

In a corresponding way, placement of attachment points on the anchor is critical for the behavior and the balance of the anchor. Use of the main tether connection point on the anchor also for the pull-down operation, will ensure a correct load distribution. An additional pad eye on the anchor may require an increase of the anchor size and additional cost.

In general there is a request to have a as light weight pontoon structure MWA 11 as possible, since buoyancy is normally at a high cost. The more connecting points the heavier the buoyancy unit 11 will is. Therefore the connecting points for the pull down arrangement of the present invention, are located at the upper 17 and lower 14 trunnion connecting elements.

LEGEND DRAWING DETAILS

10—Installation vessel

11—Mid Water Arch (MWA)

12—Winch line for pull-down

12*a*,12*b*—Bridle-line for pull-down

14—ROV operable interface component for tether termination to the anchor

15—Shackle for connection of wire block

16—Padeye for connection to anchor

17—ROV operable interface component for tether termination to the MWA

18—Shackle for connection of pull-down bridle

19—Seabed anchor

20—Winch for pull-down line

21—Wire block, connectable to shackle by ROV

22—Main tether arrangement

The invention claimed is:

1. A method for maintaining or replacing a tether line that is anchoring a buoyancy unit to an underwater or seabed anchoring installation, comprising the steps: connecting a pull down line to the buoyancy unit; guiding the pull down line through a block fixed to a lower anchoring installation; pulling down the buoyancy unit to slacken the tether line; and then performing maintenance or replacement on the tether line.

2. The method according to claim 1, further comprising: installing and operating the pull down line by a winch arrangement of an installation vessel.

3. The method according to claim 2, further comprising: using a block unit including a pulley unit.

4. The method according to claim 3, further comprising: connecting the block unit to pre-installed shackles adjacent a sea bed anchoring unit; and connecting the pull down line to pre-installed shackles adjacent the buoyancy unit.

5. The method according to claim 1, further comprising: connecting a tether line upper termination to the buoyancy unit via a ROV operable interface component.

6. The method according to claim 1, further comprising: connecting a tether line lower termination to a seabed anchoring unit via a ROV operable interface component; and connecting a padeye unit to the seabed anchor.

7. The method according to claim 1, further comprising: installing the pull down line by means of a ROV.

8. Device for maintaining or replacing a tether line anchoring a buoyancy unit to an underwater or seabed anchoring installation, characterized in having a block fixed to a lower anchoring installation, and a pull down line connected to the buoyancy unit and guided through said block whereby in response to pulling down of said pull down line the buoyancy unit is pulled down to slacken the tether line to allow maintenance or replacement to be performed.

9. Device according to claim 8 characterized in having a winch arrangement on an installation vessel and in having said pull down line installed and operated by said winch arrangement.

10. Device according to claim 9 characterized in that said block includes a pulley unit.

11. Device according to claim 10 characterized in having first preinstalled shackles adjacent the sea bed anchoring installation and second preinstalled shackles adjacent the buoyancy unit and in that said block is connect to said preinstalled shackles adjacent the sea bed anchoring installation, and said a pull down line end is connected to said preinstalled shackles adjacent the buoyancy unit.

12. Device according to claim 8 characterized in that a tether line upper termination is arranged to connect to the buoyancy unit via a ROV operable interface component.

13. Device according to claim 8 characterized in that a tether line lower termination is connected to the sea bed anchoring unit via an ROV operable interface component and includes a padeye unit for connection to a sea bed anchor.

* * * * *

UNITED STATES PATENT AND TRADEMARK OFFICE

CERTIFICATE OF CORRECTION

PATENT NO. : 9,290,238 B2
APPLICATION NO. : 14/397554
DATED : March 22, 2016
INVENTOR(S) : Lars Bjoland et al.

It is certified that error appears in the above-identified patent and that said Letters Patent is hereby corrected as shown below:

In the claims

Column 4, line 26, "connect" should be – connected – line 28, cancel "a"

Signed and Sealed this
Twenty-eighth Day of June, 2016

Michelle K. Lee

Michelle K. Lee
*Director of the United States Patent and Trademark Office*